US005205168A

United States Patent [19]

Cattin et al.

[11] Patent Number: 5,205,168

[45] Date of Patent: Apr. 27, 1993

[54] DEVICE FOR CARRYING OUT QUALITY TEST FIRINGS AS WELL AS THE USE THEREOF

[75] Inventors: René Cattin, Steffisburg; Raymond Corthesy; Beat Kneubühl, both of Thun, all of Switzerland

[73] Assignee: Schweizerische Eidgenossenschaft vertreten durch die Eidg., Switzerland

[21] Appl. No.: 728,677

[22] Filed: Jul. 11, 1991

[30] Foreign Application Priority Data

Jul. 30, 1990 [CH] Switzerland ..... 02510/90

[51] Int. Cl.[5] ..... G01L 5/14; F15B 15/00

[52] U.S. Cl. ..... 73/167; 91/534; 91/361

[58] Field of Search ..... 73/167; 33/227, 234; 89/41.02, 41.12, 41.05, 41.06, 41.07; 91/534, 361

[56] References Cited

U.S. PATENT DOCUMENTS 3,766,778 10/1973 Henrichsen ..... 73/167
3,891,323 6/1975 Ryan et al. ..... 356/154
3,893,336 7/1975 Tucker ..... 73/167
4,126,394 11/1978 Ulrich ..... 356/152
4,178,831 12/1979 Tidemalm et al. ..... 89/41.12
4,513,782 4/1985 Contartese et al. ..... 91/361 X
4,665,795 5/1987 Carbonneau et al. ..... 89/41.03
4,977,361 12/1990 Phillips et al. ..... 318/640

FOREIGN PATENT DOCUMENTS 1961323 6/1971 Fed. Rep. of Germany .
2532413 3/1984 France .

*Primary Examiner*—William A. Cuchlinski, Jr.
*Assistant Examiner*—W. Morris Worth
*Attorney, Agent, or Firm*—Wegner, Cantor, Mueller & Player

[57] ABSTRACT

In a device for carrying out quality test firings with a gun barrel (1), a mount (2) and an automatic adjusting arrangement (4, 5, 6) for resetting the barrel (1), a given directional setpoint value is compared with the actual direction value. While the actual value is derived from a mirror (3) attached to the barrel (1) itself, the setpoint value is produced by a frequency-modulated laser beam ($\nu$) from a source mounted nonvibratingly and separately from the barrel (1) and its mounting (2). By this separation, the hit dispersion due to the mechanical components is reduced to a minimum. This device is of particular usefulness in the development and quality control of small-calibre ammunition.

9 Claims, 2 Drawing Sheets

DEVICE FOR CARRYING OUT QUALITY TEST FIRINGS AS WELL AS THE USE THEREOF

BACKGROUND OF THE INVENTION

1. Field of the Invention

The invention relates to a device for carrying out test firings for determining the quality of ammunition, comprising a barrel capable of adjustment in elevation and azimuth fixedly mounted in a support, and an automatic adjusting device for resetting the barrel to its desired direction, as well as a preferred use of the device for certain types of ammunition.

2. Description of Background Art

Devices of the above-mentioned kind, also called firing machines, are known. They are used to check the dispersion of the system elements of barrel weapons. For this purpose, the barrel is mounted on a support, after which a number of shots are fired at a target to determine the dispersion pattern (the so-called dispersion pattern target). The dispersion of the hits about the dispersion pattern target center is used as a measure of the accuracy of the weapon and the ammunition.

Such firing machines were already described by Richard Mahrholdt in the "Waffenlexikon" (F.C. Mayer-Verlag, Munchen-Hamburg, 1952; comp. pp. 362, 363). Particular mention is made there of a firing machine by Walter Gehmann, the resetting of which to its initial position, after each shot, is effected automatically by two springs arranged in a V-position. This, however, is very far from an adjustment device in the sense of an accurate resetting.

In general, the barrel of a gun is fixedly clamped in a mostly heavy and massively built support which, for absorbing the recoil, is designed to be movable in the firing direction, with the attempt being made, using springs or rubber components, to brake the recoil produced during firing and to force back the support to its initial position. Such moving systems are mostly guided by means of a sort of guide rail associated with a block fixedly anchored in the ground. In this design, the block forms the inert reference system to which the firing direction is related. Both the support and the reference system must be heavily built in order that a major portion of the forces generated by the recoil will be absorbed by mass inertia. During the resetting of the barrel or of the entire weapon, systematic errors are produced involving the accurate alignment with respect to the dispersion pattern target, as a certain amount of clearance must be provided between moving components and also because of the presence of frictional forces. With the machine tools used, this error is of an order of magnitude of about 1 mrad (0.057°), which, at a disk distance of 100 m, corresponds to a dispersion error of as much as 10 cm.

Further errors are liable to occur due to the fact that the block is set vibrating and that, eventually, its anchorage is displaced due to the impact loads produced in the course of the firing sequences. Finally, the elastic system used takes a considerable time to reset, producing a low firing rate.

From DE-A-37 03 436 it is known to use, for the aiming of a barrel weapon or a gun barrel at a dispersion pattern target, optical means including lasers as the light source and component of an aiming-point generator. The barrel weapon and the aiming-point generator are mutually coupled via a control unit, means being provided for the setting, in elevation and azimuth, of the aiming-point generator for the purpose of synchronous adjustment of the light point in accordance with the aiming of the projectile barrel. At the same time, the more distant image of the dispersion pattern target is observed on a T.V. monitor and the elevation and azimuth values of the barrel weapon are manually altered until the light point is located on the aiming cross of the dispersion pattern target. This enables the performance of target-diagram firing also at low visibility, for example during fog, snowfall or darkness, which is a declared object of the invention.

Here, too, the above-mentioned disadvantages are unqualifiedly valid, since the barrel mounting functions as the essential point of reference for the measurements. In view of the complex data linkage, including the positioning of the monitor, the angles of view, etc., accuracy of the adjustment is not very satisfactory. Due to the lack of an automatic setting of the barrel, the firing rate that can be realized is rather low.

SUMMARY OF THE INVENTION

It is an object of the present invention to propose a firing machine that overcomes the above-mentioned disadvantages of the prior art and, particularly also at high firing rates, returns the gun barrel in the shortest possible time and at the highest possible precision in direction of the dispersion pattern target, so that the share of the dispersion produced by an inaccurate setting of the gun barrel is eliminated and the dispersion pattern of the target represents solely the trajectory inaccuracy of the ammunition.

This device is intended in particular for the development and quality control of ammunition.

According to the invention this is achieved in that, a source of radiation is provided radially offset relative to the direction of firing, and the beam emitted by said source is directed to a mirror rigidly connected with the barrel and the beam reflected by said mirror is detected by a position detector arranged in the direction of firing, and that the signal outputs of the detector are led to a servomechanism which is effectively connected to the barrel.

This device permits the inertia-free measurement of barrel alignment with the target and, in case of a deviation from the desired direction, an adjustment by the servomechanism.

The radiation source is advantageously arranged behind the barrel as seen in the direction of firing, but may also be attached at the muzzle side. It is particularly suitable to have the carrier for the radiation source be of a large mass, for instance, a concrete wall resting on a heavy foundation.

In one preferred embodiment, the radiation source and the position detector are located separately from the barrel. In this way it is possible to avoid any interfering mechanical coupling between recoil and instruments.

The invention works with commercially available building elements in the visible range.

The invention uses frequency modulation to eliminate stray and ambient light influences without the need for output-reducing filters.

The invention provides an optimal radiation output which precludes eye damage during the operation of the device.

The invention also provides short response times and permits a high firing rate, which is particularly advantageous with the testing and development of ammunition.

The invention is particularly useful during the large-series testing of rifle ammunition of a calibre of 5.7 mm.

BRIEF DESCRIPTION OF THE DRAWINGS

In the following, the invention is described in greater detail with the aid of a practically realized example. In the associated drawings.

DESCRIPTION OF THE PREFERRED EMBODIMENT

Figure 1:
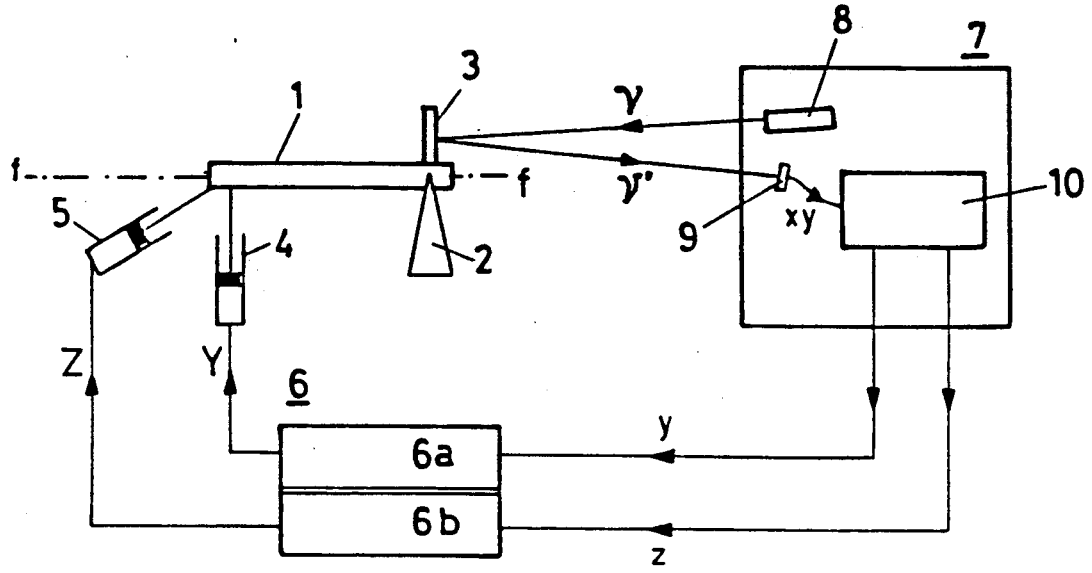
FIG. 1 is a schematical representation of the entire device.

In the upper left of FIG. 1 there is seen the barrel 1 which is movable about a horizontal and a vertical axis and is clampedly held in a mount 2, which mount, on its part, may be fixedly attached to a foundation. The muzzle of the barrel points to the left where, in extension of the center line, the dispersion pattern target is assumed to be located. The axis of the firing direction is marked with the letter f.

A plane mirror 3 is attached in the region of the cartridge-chamber outlet of the gun barrel 1. With its reflective surface, it points towards the instrument carrier 7. This carrier 7 may be installed in direct proximity of the device, but separate from the barrel 1 and its mount 2, in order not to be set vibrating during the test firing. The instrument carrier 7 is preferably attached to a massive wall.

The carrier 7, represented here schematically, carries a radiation source 8, preferably a laser diode, furthermore a position detector 9, preferably a PIN-photodiode, as well as an evaluation circuit (computer-comparator unit) 10 with two outputs Z and Y which, via control units 6*a*, 6*b* cause the hydraulic cylinders 4, 5 to be pressurized.

In the case of the present embodiment, the adjusting members are conventional, hydraulically operating setting cylinders, one each for adjustment in the horizontal and in the vertical direction.

Figure 2:
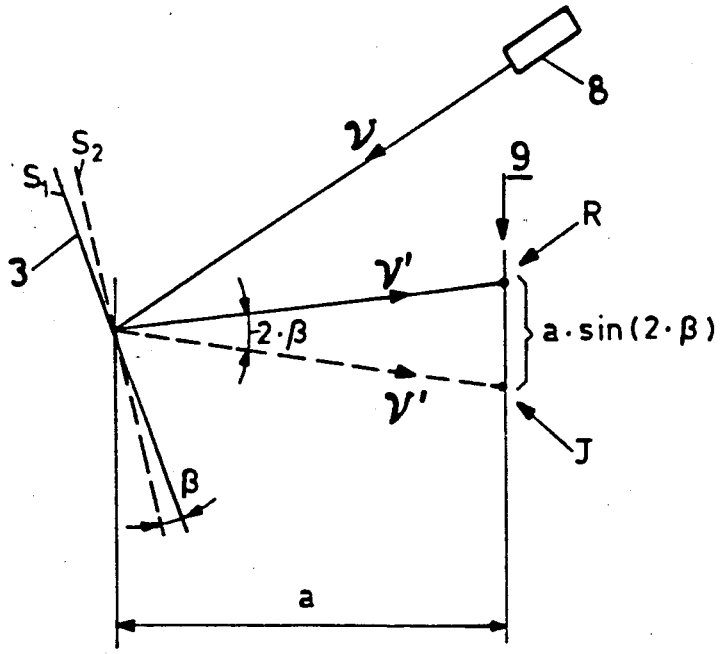
FIG. 2 demonstrates the principle of signal evaluation at the linked mirror.

The radiation source of FIG. 1, i.e., the laser diode 8, sends its light beam $\nu$, modulated with a frequency of 20 kHz and of a wavelength of 850 nm, onto the plane mirror 3 which, in the reference position $S_1$, reflects the light point onto point R of the photodiode 9. As shown in FIG. 2, R stands for the setpoint which, in the simplest case, is located precisely in the center of the active field of the photodiode 9. If now the barrel shifts, thereby deflecting the mirror 3 (which is rigidly attached to it) e.g., into the plane marked $S_2$, then the reference beam will be deflected by twice the value and will hit point J, which corresponds to the actual value. According to the deviation of the barrel from its reference or ideal position, different actual-value points J are imaged on the PIN-photodiode 9. The size of the PIN-photodiode must be coordinated with the distance a from the mirror 3 and the maximum resettable angular deviation $\beta$ of the latter, taking into account the geometrical relationships as indicated in FIG. 2.

If the distance between the light transmitter and light receiver (both of which are normally integrated into the control unit) and the mirror rigidly anchored to the barrel, is selected to be, for example, 1 m, this will result in a possible angular resolution of $1.25\times10^{-3}$ mrad, corresponding to 0.26 arc seconds. Given a distance to the dispersion pattern target of 100 m, for example, this means a detectable deviation of 0.13 mm which, also in practice, corresponds to an improvement vis a vis the above-mentioned prior art device, of more than one order of magnitude.

A PIN-photodiode measures two separate analog output signals xy at the input amplifier of the computing and evaluating circuit 10. The latter processes the input signals and turns the horizontal deviation on the one hand, and the vertical deviation on the other, into control impulses which, at the output side, are fed to the control elements 6*a* and 6*b* which are responsible for the adjusting members.

The photodiodes used are Schottky barrier diodes, specially designed for position measurement, and per se known (see periodical "Elektronik" Francis-Verlag GmbH, Munchen, 1972, H. 1, pp. 13–15) and commercially available, as is the PIN laser diode with a maximum radiation output of 3 mw, in conjunction with an equally known modulator with a frequency of 10 to 40 kHz.

Figure 3:
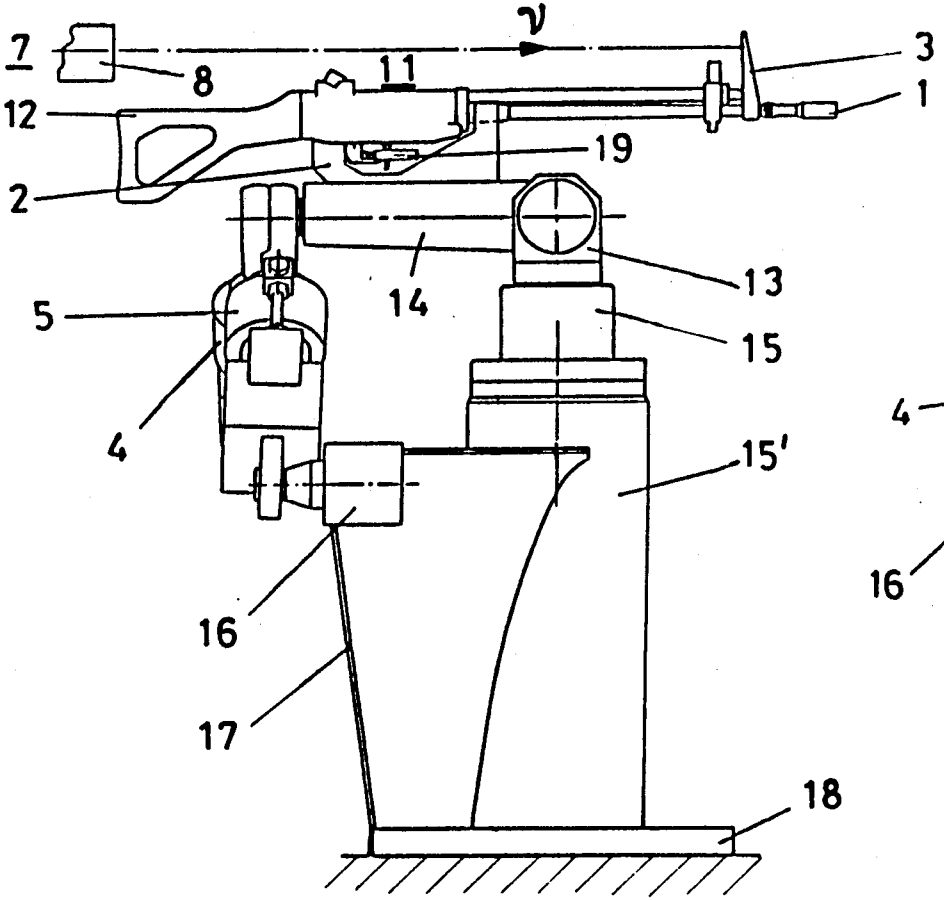
FIG. 3 shows an actually realized firing machine with a mounted small-calibre rifle.

In a preferred embodiment for large-series testing of rifle ammunition of a calibre of 5.7 mm as shown in FIG. 3, using a standard weapon 11, the laser beam $\nu$ emitted by the radiation source 8 hits a mirror 3 clamped to the barrel 1. The weapon, including its butt 12, rests in its usual firing position on a mount 2, to which it is clampedly attached.

Figure 4:
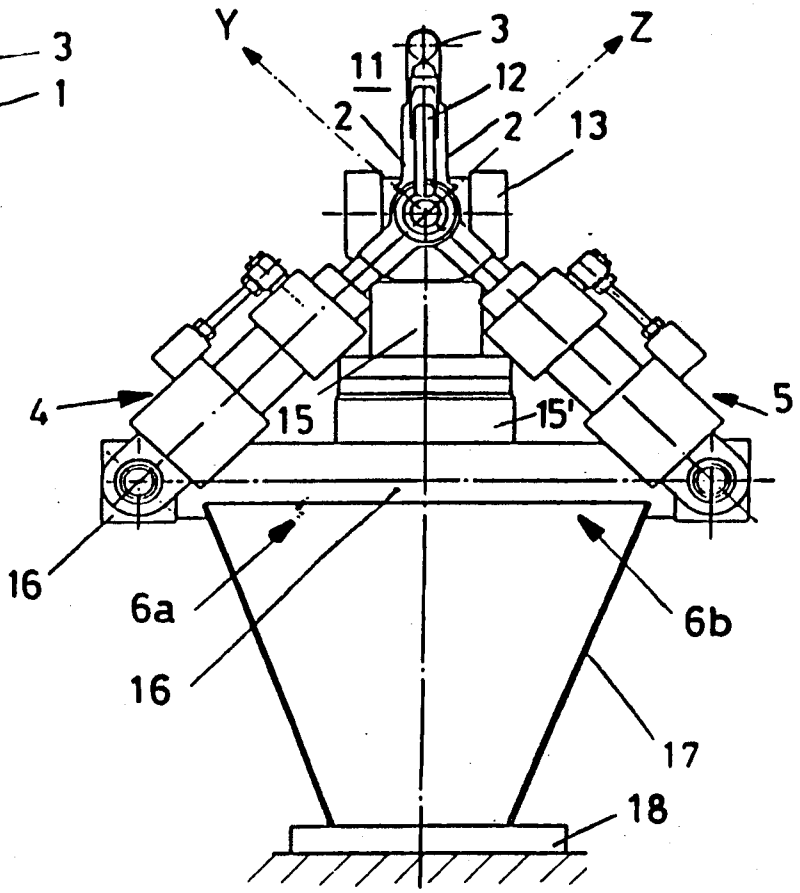
FIG. 4 is the representation of FIG. 3 as rotated by 90°.

In its turn, the mount 2 rests on a support 14 mounted in a cradle 13, which support is adjusted in the Y- and the Z-directions by two adjusting members 4 and 5 designed as hydraulic cylinders, as shown in FIG. 4. In the interior of a housing 17, and by means of the control units 6*a*, 6*b* not explained here in greater detail, the adjusting members 4, 5 are in the usual way electromechanically controlled and served, using servo-components. The adjusting members 4 and 5 are articulatedly attached at their ends to a massive beam 16 arranged at a hollow column 15' and the housing 17. The column 15' on its part centers a shaft-like column portion 15.

The entire structure rests on a foundation plate 18 screwed to a concrete bed. Mechanically separated therefrom, at a distance of several meters, there is disposed the instrument carrier 7, also designed with large masses.

Via an electromechanical triggering arrangement 19, the device can be adapted to remote control and, with the aid of simple computer control, can be designed also for continuous firing with automatic evaluation and recording of results.

The adjustment, measurement and control elements used in the device are all commercially available and are elsewhere used in machine tool manufacture. As hydraulic unit serves a Hydro-Medio Model HM 16 (Bachofen AG, CH-8610 Uster); the two adjusting members are Storz-Hydrozylinder, Baureihe ZWDAS (E.A. Storz GmbH & Co. KG, D-7200 Tuttlingen); as 2-axes servo-control serves the System Minipos (trademark of Messrs. Wyttenbach Informatik AG, CH-4900 - Langenthal); the servo-valves to be controlled are of the Type 225F (Tokyo Precision Instr. Co., Ltd.). As a read-out device serves a scaled process controller DELTA 500 (Orbit Controls AG, CH-8952 Schlieren).

It is within the scope of the invention to provide also other arrangements instead of the preferably used optical or optoelectrical building elements. Thus it may be advisable to fixedly anchor a laser diode on the gun barrel instead of a mirror, which laser diode emits a beam hitting a photodiode, preferably a PIN-photodiode, mounted separately and nonvibratingly, which detects the positional deviation with respect to two axes and, accordingly, delivers the required analog control signals.

It is further possible, by way of kinematic inversion, to attach the radiation source to the barrel and to effect detection via a stationary mirror. It is likewise possible to detect virtual rather than real images.

According to the weapon system and the type of test, the mirror (reflector) may be arranged in different ways. In order not to introduce system-affecting masses, it is recommended, for instance with small arms, to either mount the mirror on the foresight (or cement it thereto) and/or to apply a reflective coating to the foresight mount and use it directly as reflector.

What is claimed is:

1. A device for carrying out test firings for determining the quality of ammunition, comprising:

means for mounting a barrel for relative movement with respect to a foundation;

means for firing the ammunition from said barrel; and automatic adjusting means for resetting the barrel to its desired direction after firing, said adjusting means including a source of radiation emitting a radiation beam, said source being provided radially offset relative to the direction of firing, the beam ($\nu$) emitted by said source being directed to a mirror rigidly connected with the barrel and the beam (84 ') reflected by said mirror being detected by a position detector arranged in the direction of firing; and a servomechanism operatively connected to the barrel, said servomechanism receiving signal outputs (Y, Z) from an evaluation circuit means for computing and evaluating deviations of said barrel from said desired direction using output signals from the detector.

2. The device according to claim 1, wherein the source of radiation and the position detector are mechanically separated from the support of the barrel.

3. The device according to claim 2, wherein the source of radiation is a light-emitting laser diode and the position detector is a PIN-photodiode.

4. The device according to claim 3, wherein the light-emitting laser diode is frequency-modulated.

5. The device according to claim 4, wherein the light-emitting diode is a helium/neon laser having a radiation output of less than 3 mW.

6. The device according to claim 1, wherein the servomechanism has means for horizontally and vertically positioning said barrel, said means including adjusting members for resetting the barrel, and a control unit is provided corresponding to each adjusting member to control the operation of its corresponding adjusting member.

7. The device according to claim 1, wherein the device is used for series-testing to determine the quality of small-caliber ammunition.

8. The device according to claim 1, wherein said means for mounting said barrel includes a cradle mounted on said foundation, a support movably mounted in said cradle, and a barrel mount resting on said support.

9. The device according to claim 8, wherein said servomechanism includes hydraulic actuators movably connected to said support.

* * * * *